United States Patent [19]

Wheelwright et al.

[11] 4,331,057

[45] * May 25, 1982

[54] AUTOMATIC CHORD CONTROL CIRCUIT FOR ELECTRONIC MUSICAL INSTRUMENTS

[75] Inventors: Robert W. Wheelwright, Tonawanda; Peter E. Solender, Williamsville, both of N.Y.

[73] Assignee: The Wurlitzer Company, DeKalb, Ill.

[ * ] Notice: The portion of the term of this patent subsequent to Apr. 15, 1997, has been disclaimed.

[21] Appl. No.: 55,303

[22] Filed: Jul. 6, 1979

Related U.S. Application Data

[60] Division of Ser. No. 755,173, Dec. 29, 1976, Pat. No. 4,197,777, which is a continuation of Ser. No. 586,231, Jun. 12, 1975, abandoned.

[51] Int. Cl.[3] ..... G10H 1/38; G10H 5/00

[52] U.S. Cl. ..... 84/1.17; 84/DIG. 22

[58] Field of Search ..... 84/1.01, 1.03, 1.11, 84/1.17, 1.19, 1.24, DIG. 22

[56] References Cited

U.S. PATENT DOCUMENTS

| | | | |
|---|---|---|---|
| 3,247,310 | 4/1966 | Stinson | 84/1.17 |
| 3,823,246 | 7/1974 | Hebeisen et al. | 84/1.17 |
| 3,844,192 | 10/1974 | Brand et al. | 84/1.17 X |
| 3,871,262 | 3/1975 | Robinson et al. | 84/1.17 |
| 3,889,568 | 6/1975 | Amaya | 84/DIG. 22 |
| 3,908,502 | 9/1975 | Kidd et al. | 84/DIG. 22 |
| 3,929,051 | 12/1975 | Moore | 84/1.17 |
| 3,990,339 | 11/1976 | Robinson et al. | 84/DIG. 22 |
| 4,019,417 | 4/1977 | Carlson | 84/1.01 |

*Primary Examiner*—Stanley J. Witkowski

*Attorney, Agent, or Firm*—Trexler, Bushnell & Wolters, Ltd.

[57] ABSTRACT

An automatic chord control system is readily incorporated in an electronic organ by means of large scale integrated circuit chips. The automatic chord control causes a chord or group of notes within an octave played on the lower manual keyboard to play through the upper manual voice in the octave below the lowest melody note being played on the upper manual keyboard. The proposed automatic chord control system has two operating modes. In the first mode, the notes transferred to the upper manual are generated in direct correspondence to the keys activated on the lower manual. In the second mode, the notes transferred to the upper manual are generated by a set of preset chords activated by single lower manual keys.

10 Claims, 7 Drawing Figures

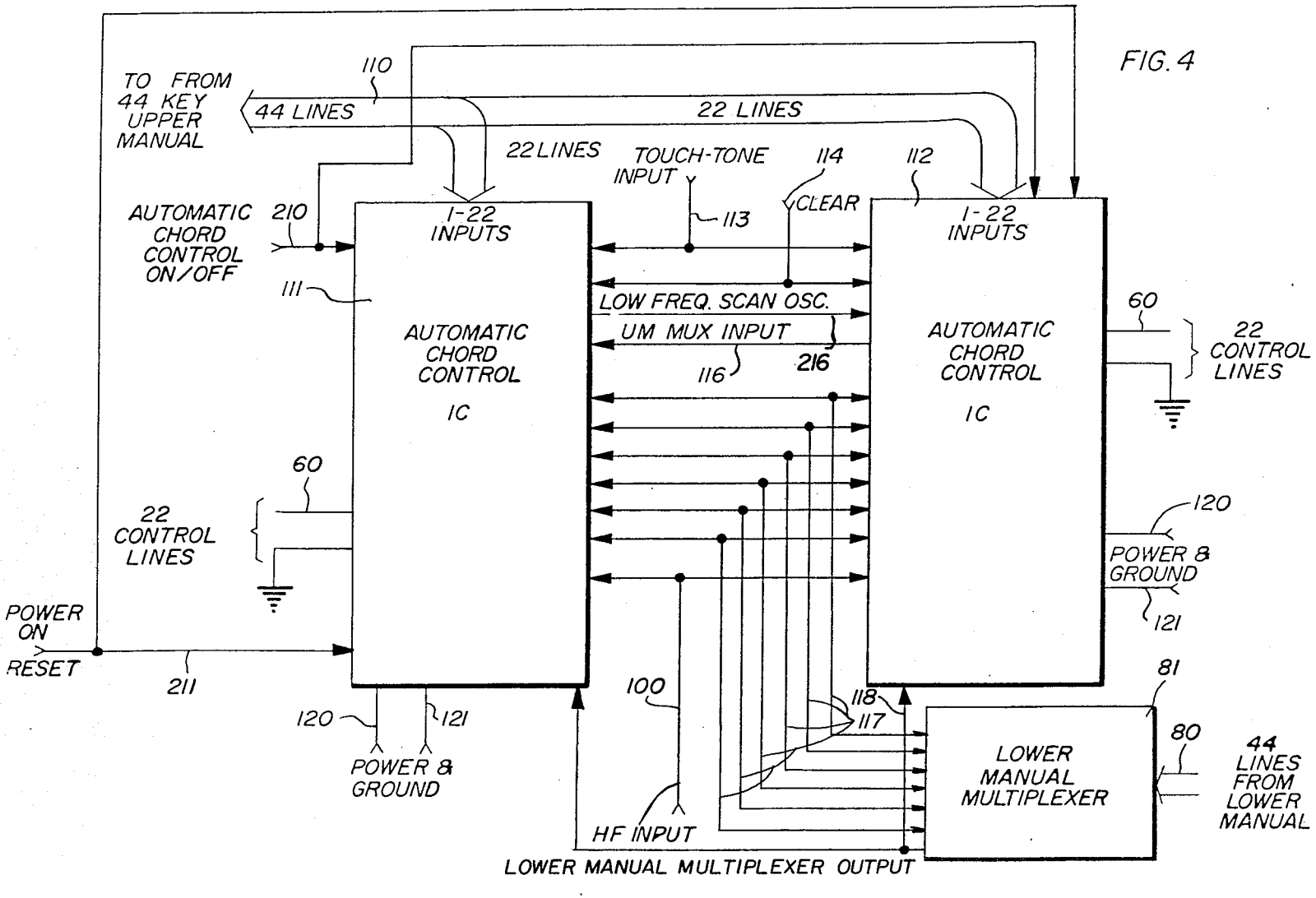
FIG. 4
22 CONTROL LINES
60
120
POWER & GROUND
121
44 LINES FROM LOWER MANUAL
80
81
LOWER MANUAL MULTIPLEXER
1-22 INPUTS
AUTOMATIC CHORD CONTROL IC
112
114
CLEAR
113
TOUCH-TONE INPUT
22 LINES
LOW FREQ. SCAN OSC.
UM MUX INPUT
216
116
118
117
100
HF INPUT
LOWER MANUAL MULTIPLEXER OUTPUT
22 LINES
1-22 INPUTS
AUTOMATIC CHORD CONTROL IC
110
44 LINES
210
111
60
121
POWER & GROUND
120
TO FROM 44 KEY UPPER MANUAL
AUTOMATIC CHORD CONTROL ON/OFF
22 CONTROL LINES
211
POWER ON
RESET

AUTOMATIC CHORD CONTROL CIRCUIT FOR ELECTRONIC MUSICAL INSTRUMENTS

CROSS REFERENCE TO RELATED APPLICATION

This application is a division of application, Ser. No. 755,173, filed Dec. 29, 1976, now U.S. Pat. No. 4,197,777, which is a continuation of Ser. No. 586,231, filed June 12, 1975, abandoned.

BACKGROUND OF THE INVENTION

This invention relates generally to electronic musical instruments, and more particularly to electronic organs of the type having upper and lower key manuals and separate chord preset controls. Specifically, the invention is directed to means for providing an improved electronic organ sound while simplifying the technique for playing. The results of this invention are equally useful to both novice and expert musicians.

Heretofore, electronic organs have been provided with circuits which allow the user to depress both accompaniment keys and solo keys on the lower and upper manuals, respectively, to provide accompaniment notes together with the solo notes, but in an octave below the solo notes being played. Such prior art approaches generally require complicated multicontact switching arrangements associated with each of the keys of the electronic organ. For example, actuation of the multicontact key switch of the lower manual is required to enable certain ones of the key switches of the upper manual so that the appropriate notes will pass through the upper manual. This required expensive hard wiring of the multitude of switch contacts between the upper and lower manuals and the electronic circuitry associated with the organ. Examples of such prior art attempt to achieve automatic chord accompaniment of musical instruments are shown in the Cookerly et al. U.S. Pat. No. 3,283,056; the Stinson U.S. Pat. No. 3,547,310 and the Robinson et al. U.S. Pat. No. 3,871,262.

SUMMARY OF THE INVENTION

Accordingly, it is an object of this invention to provide an electronic musical instrument such as an organ with automatic chord control circuit means actuated by a single contact element on each one of the plurality of key switches associated with the upper and lower manuals.

Another object of this invention is to provide an electronic musical instrument with an automatic chord control circuit coupled directly to each of the upper and lower manuals and wherein there is no interaction or coupling between the manuals to obtain transfer of the chord controls of the lower manuals to be preselected octave of the upper manual.

A feature of the present invention is the use of a generator for producing a series of signals corresponding to a plurality of musical tones selected from a plurality of keyboard portions such as the upper and lower manuals of an organ. Key operated switches associated with the keyboards are scanned to determine their state, i.e., whether they are opened or closed. A set of digital logic elements is connected to the generator means and to the key operated switches for producing tones in response to the actuation of the keys. Digital control circuits are included for producing the note of the same name in a plurality of keyboard octaves in response to actuation of at least one key on the keyboards and in response to the scanning circuit scanning the keyboards.

Although the embodiments of the invention disclosed herein may be included in various musical instruments such as pianos, accordians, and the like, a particularly useful application which is disclosed herein is in connection with an electronic organ. The system of this invention is preferably built in the organ by incorporating large scale integrated circuit chips of the type presently being used in the organ circuitry.

The invention disclosed herein will be best understood when described in connection with a two manual electronic organ. When playing a two manual organ, it is often desirable to have a chord or group of notes played on the lower keyboard, played also on the upper keyboard in an octave position immediately below the lowest melody note being played. Utilizing the proposed automatic chord control system of this invention, this function is performed automatically by scanning the keys of the upper and lower keyboards and enabling the keys one at a time. The system disclosed herein is quite flexible and can be easily adapted to accommodate a number of specialized performance features.

For example, the circuit arrangement can be designed to inhibit the playing of the two adjacent notes below the melody note on the upper manual in order to eliminate discordant combinations from occurring. Furthermore, in this configuration, where the two adjacent notes are inhibited, a design option is also available which will lower any inhibited chord note a complete octave so that the complete chord is played with the discordant combination thereby eliminated. This basic system or mode of operation can be implemented by logic control circuits.

Many objects, features and advantages of this invention will be more fully realized and understood from the following detailed description when taken in conjunction with the accompanying drawings wherein like reference numerals throughout the various views of the drawings are intended to designate similar elements or components.

BRIEF DESCRIPTION OF THE DRAWINGS

FIG. 4 is a simplified block diagram of the large scale integrated circuit chip configuration utilized in accordance with this invention.

DETAILED DESCRIPTION OF THE ILLUSTRATED EMBODIMENT

Figure 1:
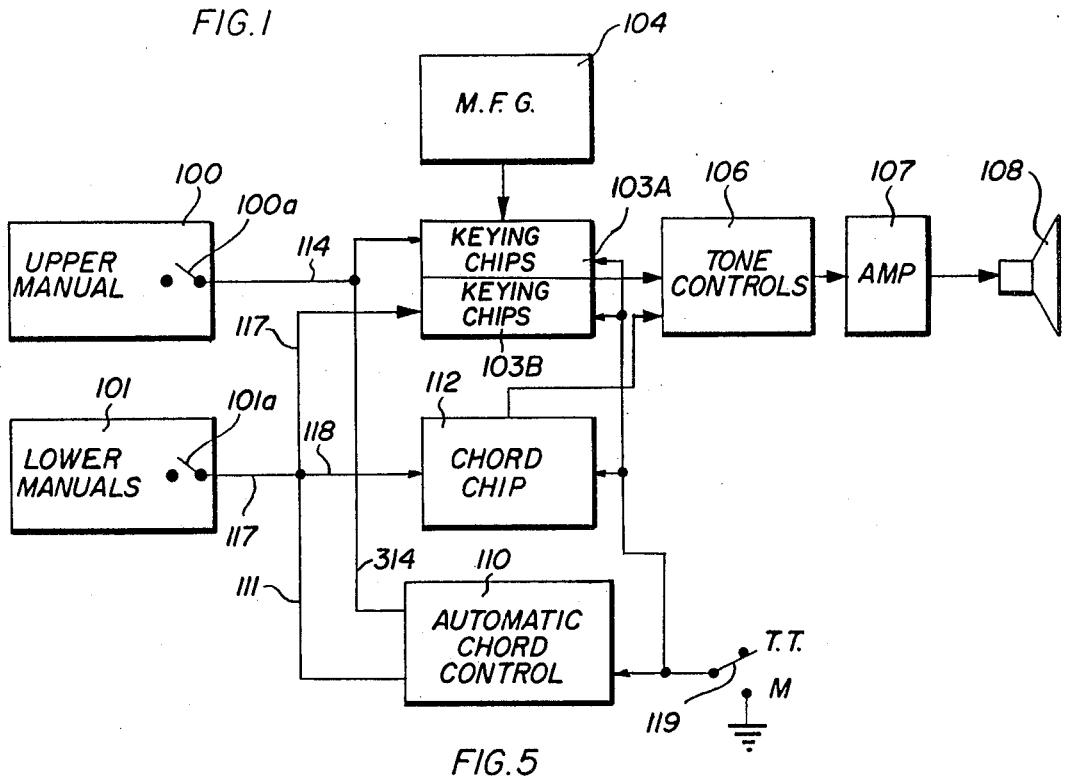
FIG. 1 is a simplified block diagram of an electronic organ wherein the automatic chord control circuit of this invention is used.

FIG. 1 illustrates a simplified block diagram of an electronic organ wherein the automatic chord control circuit of this invention is utilized. An upper manual of the electronic organ is designated generally by reference numeral 100 and a lower manual of the electronic organ is designated generally by reference numeral 101. The upper manual includes a single switch element 100*a* for each key, preferably being of a single pole, single throw type. Similarly, the lower manual 101 includes a single switch element 101*a* for each key, also preferably of the single pole, single throw type. It will be noted that the lower manual can be replaced by a chord button arrangement instead of key switches or the entire multinote chord can be played by the actuation of a single key on the lower manual.

The upper manual keyswitches 100A are directly coupled to the keying chips 103A which are preferably of the large scale integrated circuit type. Also directly coupled to the keying chips 103B are the lower manual keyswitches 101A. A multifrequency generator 104 produces the notes which are gated by the keying chips 103 and amplified and reproduced in the tone control circuit 106, amplifier circuit 107 and audio output speaker circuit 108. The lower manual 101 is coupled to an automatic chord control circuit 110 through a direct line 111. The keys of the lower manual 101 are also coupled directly to the keying chips 103B and there is no direct interconnection between the upper and lower manuals. This feature enables simplified single pole, single throw key switch elements 100*a* and 101*a* to be used with great efficiency and economy.

Each of the key switches 100*a* of the upper manual 100 is coupled over a single line to the keying chips 103A. Line 114 represents a plurality of lines corrsponding in number to the number of keys of the upper manual. The lower manual key switch 101*a* is also coupled to its keying chips over a single line representing a group of lines designated by reference numeral 117. A chord chip 112 also receives signals from the lower manual 101 over a direct coupled line 118. The Automatic Chord Control 110 receives lower manual signals on line 111. When switch 119 is opened (in the TT-Touch Tone position) the chord chip produces output signals to the tone controls 106 corresponding to the chord represented by the note played on the lower manual. In this mode, the lower manual keying chips 103B are disabled and the lower manual just provides chords. In addition, the automatic chord control circuit will enable upper manual keys to play on line 314 corresponding to the chords produced on the lower manual. Line 314 which represents the upper manual notes to and from the automatic chord control 110 is bidirectional-receiving information on upper manual notes being played by the keyboard and providing output information on what additional upper manual notes are to be played. When the switch 119 is actuated to the grounded (M-Manual) position, the automatic chord control circuit 110 transforms like named lower manual notes to the upper manual by line 314 to the octave below the lowest upper manual note actuated. The chord chip 112 is disabled and the lower manual keying chips 103 are enabled in the switch 119 grounded position.

The following is a description of the basic operation of the system when two 44 note manuals are used. However, it will be understood that the embodiments disclosed herein are not limited to 44 note manual applications, and can be easily adapted to any keyboard configuration. Table I illustrates the upper keyboard notes which are enabled in response to playing chord notes on the lower keyboard. This table illustrates the case where the two notes immediately below the upper manual note activated are inhibited to eliminate discordants.

TABLE I

| UPPER KEYBOARD ENABLED NOTES | | | | | |
|---|---|---|---|---|---|
| Reference Number | Upper Activation | Sampled Notes | Reference Number | Upper Activation | Sampled Notes |
| 1 | F1 | None | 23 | D#3 | 12–20 |
| 2 | F#1 | None | 24 | E3 | 13–21 |
| 3 | G1 | None | 25 | F3 | 14–22 |
| 4 | G#1 | 1 | 26 | F#3 | 15–23 |
| 5 | A1 | 1–2 | 27 | G3 | 16–24 |
| 6 | A#1 | 1–3 | 28 | G#3 | 17–25 |
| 7 | B1 | 1–4 | 29 | A3 | 18–26 |
| 8 | C2 | 1–5 | 30 | A#3 | 19–27 |
| 9 | C#2 | 1–6 | 31 | B3 | 20–28 |
| 10 | D2 | 1–7 | 32 | C4 | 21–29 |
| 11 | D#2 | 1–8 | 33 | C#4 | 22–30 |
| 12 | E2 | 1–9 | 34 | D4 | 23–31 |
| 13 | F2 | 2–10 | 35 | D#4 | 24–32 |
| 14 | F#2 | 3–11 | 36 | E4 | 25–33 |
| 15 | G2 | 4–12 | 37 | F4 | 26–34 |
| 16 | G#2 | 5–13 | 38 | F#4 | 27–35 |
| 17 | A2 | 6–14 | 39 | G4 | 28–36 |
| 18 | A#2 | 7–15 | 40 | G#4 | 29–37 |
| 19 | B2 | 8–16 | 41 | A4 | 30–38 |
| 20 | C3 | 9–17 | 42 | A#4 | 31–39 |
| 21 | C#3 | 10–18 | 43 | B4 | 32–40 |
| 22 | D3 | 11–19 | 44 | C5 | 33–41 |

If a CEG chord is played anywhere on the lower manual, the activation of $E_2$ on the upper keyboard would produce the chord inversion $C_2$, $E_2$, $G_1$ from the automatic chord control circuit. The keying of $G_4$ instead of $E_2$ would produce the chord $C_4$, $E_4$, $G_4$ while the activation of $C_3$ would produce the chord $C_3$, $E_2$, $G_2$.

The note activated on the upper manual does not have to be contained in the group of notes transferred to the upper manual. However, the transferred notes will still play in the octave below the upper manual note played. For example, if a CEG chord was played on the lower, the keying of the $G\#_2$ on the upper manual would result in a $C_2$, $E_2$, $G_2$ chord combination on the upper manual in addition to the $G\#_2$ note playing. With the inhibit option shown in table I, the $G_2$ note would not be played. However, utilizing the alternate inhibit mode, the G note would be lowered one octave to produce the chord inversion $C_2$, $E_2$, $G_1$.

In any case, the melody note or notes played when compared to the transferred notes produced on the upper keyboard is always above in musical scale. Thus, if a note or combination of notes above the lowest note activated on the upper manual is also activated on the upper manual, this note or combination of notes will be played in the normal manner. The selection process can thus be categorized as a low note, lower octave selection technique. If desired, the scanning method can be revised to incorporate a high note and/or higher octave preference system.

In accordance with the present invention, the automatic chord control system disclosed herein utilizes a dynamic repetitive keyboard search technique. For example, if the low note, lower octave preference system is used, the keyboard scanning operation or electronic searching will start from the low end of the upper keyboard and proceed to the right on the keyboard. As soon as a note activation is detected, the search mode is stopped and the sample mode is initiated. The system is then cycled from the activated note down toward the lower end of the keyboard and those keyer input signals which correspond to the notes depressed on the lower manual are activated in the octave immediately below the melody note being played in the upper keyboard. The search and sample modes of operation are repeated periodically at a rate of about 25 times per second. Just prior to the initiation of a search mode, all upper manual keyer inputs are turned off with the exception of those activated directly from the keyboard. Thus, any change in the status of the keyboard activations will be detected within approximately 40 milliseconds. The amount of time during which the automatic chord control keyboard enables will be deactivated while searching and sampling is limited to 100 to 200 microseconds. Thus, in one second, only about 2.5 to 5.0 milliseconds will be used for determination of the automatic chord control notes to be activated on the upper manual.

In order to avoid certain discordants, it may be desirable in the sample mode to enable only nine notes and inhibit the two notes below the upper manual keyboard activation. Of course, that keyboard portion enabled during the sample mode can be shifted up or down quite readily without major modifications to the circuit. In doing this for the case of inhibiting the adjacent two notes, the sample note may be extended down further to pick a note of the chord in an octave position below that of the inhibited note.

Figure 2A:
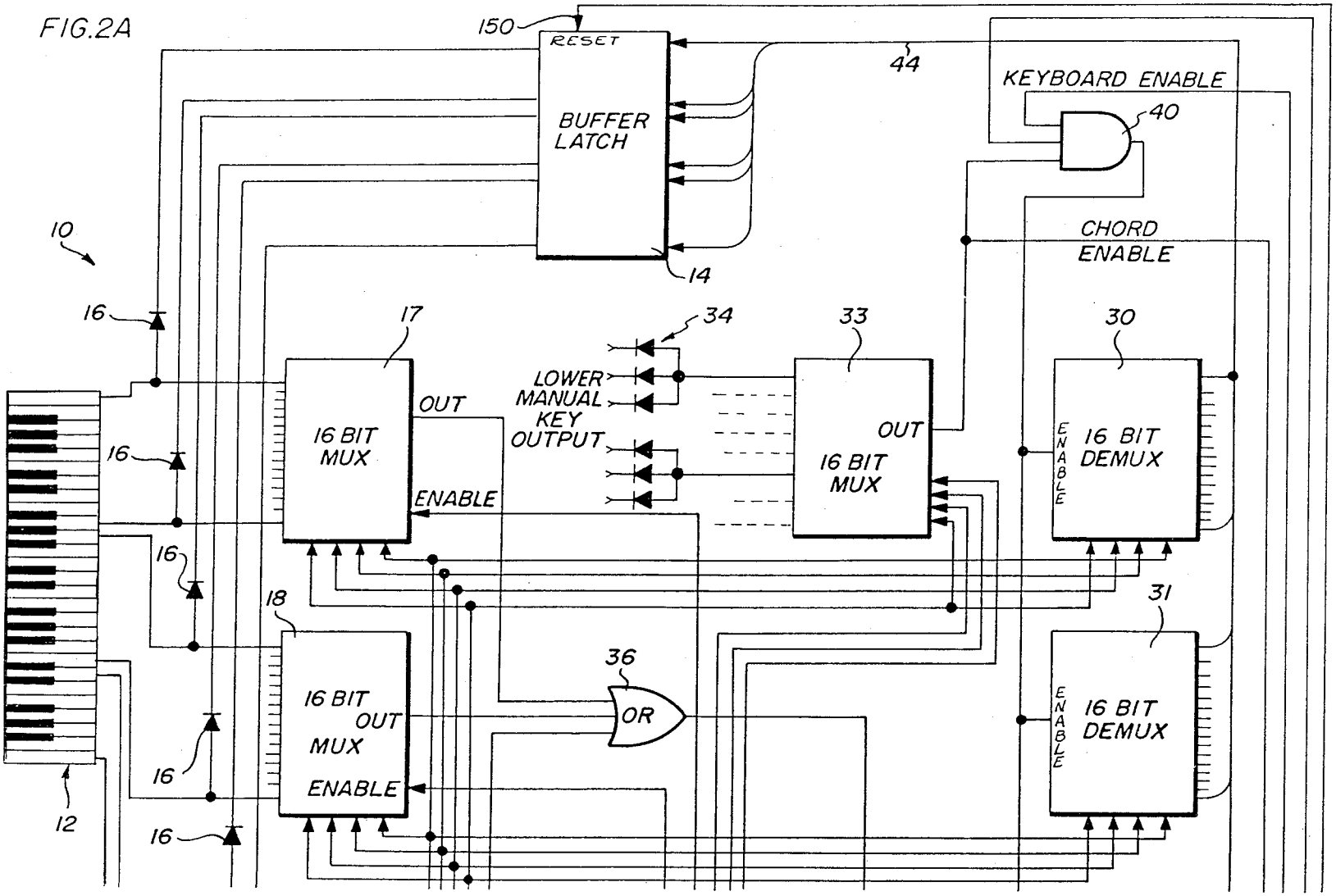
FIGS. 2A and 2B are to be placed horizontally, one above the other, with FIG. 2A on top to provide an overall schematic logic block diagram of one form of the automatic chord control of this invention.
Figure 2B:
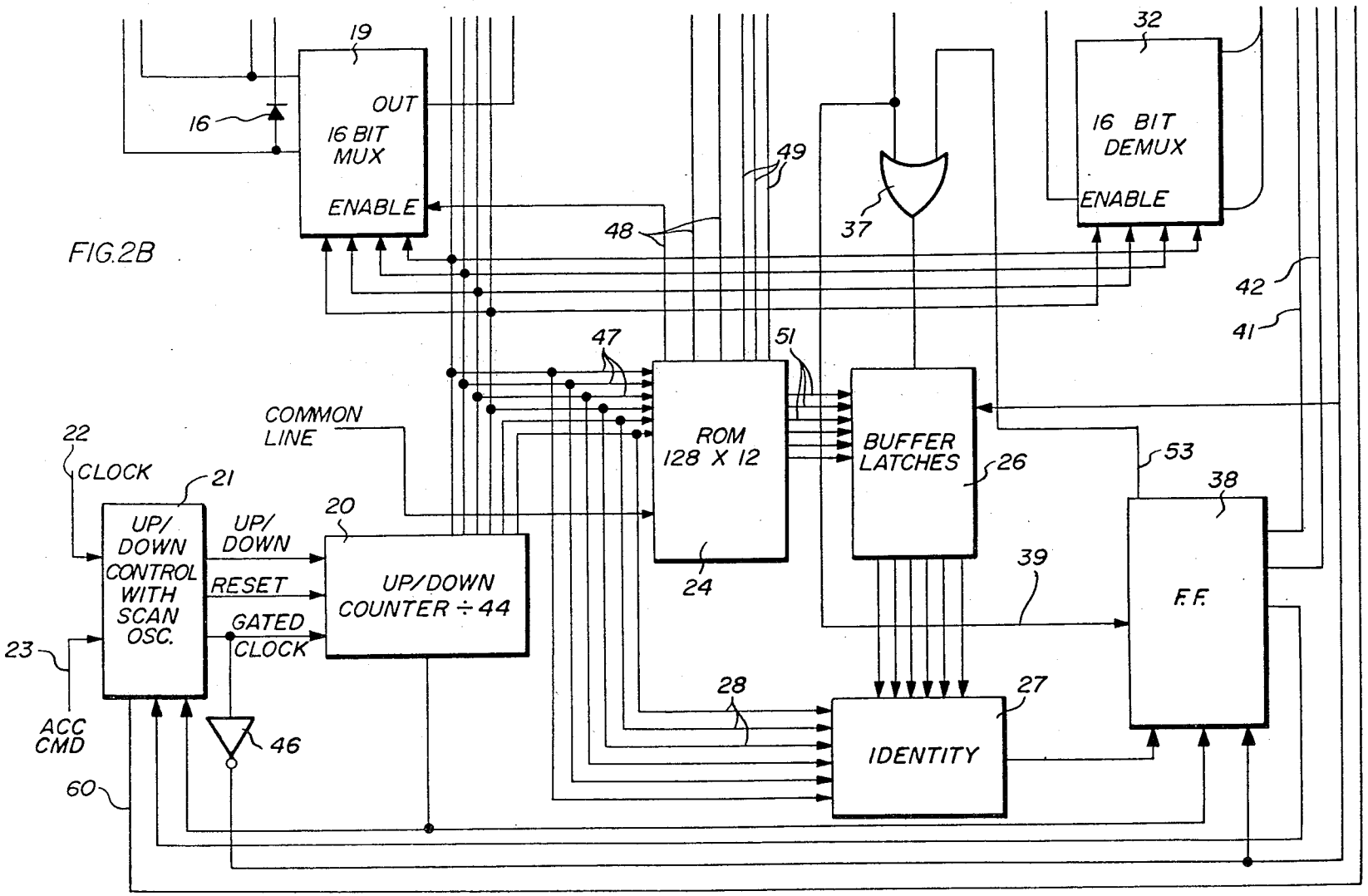

Referring now to FIGS. 2A and 2B, there is seen a simplified block diagram of the electronic logic circuitry utilized to accomplish the automatic chord control functions of this invention. The circuit embodiment disclosed is shown with a 44 note upper keyboard but, as mentioned previously, the general system is not limited to any keyboard size. Table I details the enable notes on the upper keyboard for each possible upper keyboard activation. In order to better understand Table I, it must first be seen that all of the notes on the keyboard are references to a consecutive count in the up-down counter. Therefore, note $F_1$ is count 1 and note $C_5$ is count 44 with all of the notes therebetween being successively numbered. In this circuit arrangement the sequentially enabled notes are in the octave below the activated note, but do not include the two notes directly below the activated note. Other operational modes include the case where no inhibit of adjacent notes is provided or the case where the inhibited note is played one octave below. This inhibiting features is intended to eliminate possible discordants, as mentioned above. Any activation on the lower keyboard will sequentially enable the corresponding octavely related notes on the upper keyboard. When the lower and upper keyboard sequential enables coincide, the note or notes selected will be played.

In the chord control circuit of FIGS. 2A and 2B designated generally by reference numeral 10, the key switches of the 44 note upper manual keyboard 12 referred to as 100A in FIG. 1 heretofore are coupled through 16 bit multiplexers designated by reference numerals 17, 18 and 19 to OR gate 36. Upper manual outputs are also provided from buffer latch 14 on the same lines as the inputs from keyboard 12 through a corresponding plurality of diodes 16. Also coupled to the multiplex circuits 17, 18 and 19 is the output of the up-down counter divide-by-44 circuit 20. The up-down counter divide-by-44 circuit 20 is controlled by an up-down control and scan oscillator 21. The input signal along the line 22 of the up-down control circuit 21 is a clock input while the automatic chord control command signal which turns the circuit on or off is delivered to the up-down control circuit 21 through a line 23. The output of the up-down counter divide-by-44 circuit 20 is also delivered to a read only memory 24 which has a 128-by-12 matrix array. One set of signals from the read only memory circuit 24 is also delivered to buffer latch circuits 26 which, in turn, are tied to an identity circuit 27. Also tied to the identity circuit 27 is the output of the up-down counter divide-by-44 circuit 20 over the plurality of lines 28.

The output from the up-down counter divide-by-44 circuit 20 is also delivered to the input of three 16 bit demultiplexing circuits 30, 31 and 32. The lower manual key inputs are delivered to a 16 bit multiplex circuit 33 via a plurality of diodes designated generally by reference numeral 34. The output of OR gate 36 goes to one input of a second OR gate 37 and to the input of a flip-flop circuit 38 via a line 39. The output of the 16 bit multiplex circuit 33 is coupled to one input of an AND gate 40 and to an input of the flip-flop circuit 38 over a line 41. The AND gate 40 has a second input thereof coupled to the flip-flop 38 over a line 42 and a third input delivered thereto via an invertor circuit 46 at the output of the up-down control and scan oscillator 21. The output of the AND gate 40 enables the 16 bit demultiplexer circuits 30, 31 and 32 during the keyboard scanning operation.

It will be understood that the 16 bit demultiplexing circuits 30, 31 and 32 have 16 output lines extending therefrom along the line or cable 44 to the input of the buffer latch circuit 14. It will also be noted that the buffer latch circuit 14 has a reset signal on line 150 delivered thereto from the up-down control and scan oscillator 21.

In the circuit arrangement of FIGS. 2A and 2B, the lines from the 16 bit multiplex circuits 17, 18 and 19 to the upper manual 12 include both the information on the state of the upper manual keyboard and logic drive signals to the keyers to enable the appropriate tone generators in addition to the activated notes. The lower keyboard input signals are delivered through the plurality of diode OR gate circuits 34 to the input of the 16 bit multiplex circuit 33. Each group of diodes is tied to an appropriate note of each octave, for example, each F in the octave passes through the ganged group of diodes and each G of the octave is tied together to the next group of diodes and so on. The addresses for each multiplexer circuits 17, 18 and 19 and corresponding demultiplexer circuits 30, 31 and 32 come from the counter states and from the read only memory (ROM) 24. The lower manual multiplexer 33 is addressed from the ROM 24 with the exception of the least significant bit. Table II illustrates when each input of each multiplexer or demultiplexer is activated as a function of the up-down counter divide-by-44 states.

TABLE II

| MULTIPLEXER INPUTS ENABLED | | | | | |
|---|---|---|---|---|---|
| (From Table I) Reference Number | Upper Manual Mux & Demux Enabled And Inputs Enabled | On Mux 33 Lower Manual Input Enabled | (From Table I) Reference Number | Upper Manual Mux & Demux Enabled and Inputs Enabled | Lower Manual Input Enabled |
| 1 (F1) | 17,30-1 | 1 | 23 (D#3) | 18,31-7 | 11 |
| 2 (F#1) | 17,30-2 | 2 | 24 (E3) | 18,31-8 | 12 |
| 3 (G1) | 17,30-3 | 3 | 25 (F3) | 18,31-9 | 1 |
| 4 (G#1) | 17,30-4 | 4 | 26 (F#3) | 18,31-10 | 2 |
| 5 (A1) | 17,30-5 | 5 | 27 (G3) | 18,31-11 | 3 |

TABLE II-continued

| | MULTIPLEXER INPUTS ENABLED | | | | |
|---|---|---|---|---|---|
| (From Table I) Reference Number | Upper Manual Mux & Demux Enabled And Inputs Enabled | On Mux 33 Lower Manual Input Enabled | (From Table I) Reference Number | Upper Manual Mux & Demux Enabled and Inputs Enabled | Lower Manual Input Enabled |
| 6 (A#1) | 17,30-6 | 6 | 28 (G#3) | 18,31-12 | 4 |
| 7 (B1) | 17,30-7 | 7 | 29 (A3) | 18,31-13 | 5 |
| 8 (C2) | 17,30-8 | 8 | 30 (A#3) | 18,31-14 | 6 |
| 9 (C#2) | 17,30-9 | 9 | 31 (B3) | 18,31-15 | 7 |
| 10 (D2) | 17,30-10 | 10 | 32 (C4) | 18,31-16 | 8 |
| 11 (D#2) | 17,30-11 | 11 | 33 (C#4) | 19,32-1 | 9 |
| 12 (E2) | 17,30-12 | 12 | 34 (D4) | 19,32-2 | 10 |
| 13 (F2) | 17,30-13 | 1 | 35 (D#4) | 19,32-3 | 11 |
| 14 (F#2) | 17,30-14 | 2 | 36 (E4) | 19,32-4 | 12 |
| 15 (G2) | 17,30-15 | 3 | 37 (F4) | 19,32-5 | 1 |
| 16 (G#2) | 17,30-16 | 4 | 38 (F#4) | 19,32-6 | 2 |
| 17 (A2) | 18,31-1 | 5 | 39 (G4) | 19,32-7 | 3 |
| 18 (A#2) | 18,31-2 | 6 | 40 (G#4) | 19,32-8 | 4 |
| 19 (B2) | 18,31-3 | 7 | 41 (A4) | 19,32-9 | 5 |
| 20 (C3) | 18,31-4 | 8 | 42 (A#4) | 19,32-10 | 6 |
| 21 (C#3) | 18,31-5 | 9 | 43 (B4) | 19,32-11 | 7 |
| 22 (D3) | 18,31-6 | 10 | 44 (C5) | 19,32-12 | 8 |

It should be noted that the multiplexer 33 enables like notes on the lower keyboard. Also at no time does more than one note become enabled because the system is a cycling system which never dwells on more than one particular note at a time.

In order to describe the operation of the circuit of FIGS. 2A and 2B, an example of one possible playing configuration is hereby illustrated. It does not imply a limitation to the system as any keys can be depressed on upper and lower manuals. Assume that the CEG chord is played on the lower keyboard. It is not important where on the lower keyboard this chord is played because all like notes are diode OR'd together by the diode circuits 34, as mentioned above. Also assume that the $C_3$ note (counter reference #20) is activated on the upper keyboard 12. The up-down control circuit 21 contains a scan oscillator which initiates the search mode at a periodic rate of approximately 25 cycles per second. In this mode the up-down counter, which is reset at zero, counts up starting at count 1. In addition, the buffer latch circuits 14 are initially reset to zero by reset line 150. The OR gate 36 contains the summed outputs of each of the three multiplex circuits 17, 18 and 19, and the multiplexers and their respective inputs are enabled, as shown in Table II. The read only memory circuit 24 receives the six counter states through a plurality of lines 47. The actual one of 16, four bit address lines to the three multiplex circuits 17, 18 and 19 are the four least significant bits outputs of the counter. The read only memory circuit 24 produces the particular input multiplex enable at a given time on one of the three lines 48. These lines are connected to the enable input of each of the multiplex circuits 17, 18 and 19. The read only memory circuit 24 also produces three output signals along the address lines 49 coupled to the enable inputs of the 16 bit multiplexer 33 for the lower manual input. The multiplexer 33 is enabled in accordance with Table II, set forth hereinabove. The fourth line is the least significant bit of the counter which is the same for all multiplexers. As the search mode proceeds with the counter counting in the upward direction, the OR gate 36 will indicate the presence of the first activated note. When the activated note is detected, the system transfers to the sample mode and two functions immediately occur. These two sample mode functions are the strobing of the buffer latch circuit 26 through the OR gate 37 and the setting of the flip-flop circuit 38. The latching circuits 26 are strobed to the state of the six lines on the output lines 51 from the read only memory circuit 24. These outputs correspond to the lower limit of the enable notes corresponding to the activated note shown in Table I.

In the example chosen $C_3$, corresponding to reference number 20, was activated so that the state of lines 51 and latching circuit 26 will be the binary nine position as follows (001001). The setting of flip-flop circuit 38 will reverse the up-down counter 20 from counting up to counting down through the up-down control circuit 21. In actual circuit configuration, the flip-flop circuit 38 consists of three flip-flops in a shift register formation. However, it will be understood that any suitable flip-flop circuit to achieve the appropriate logic function can be used. After three counts the third shift state will be set and this signal is used over the line 42 to enable the AND gate 40 which is a keyboard enable signal. After three counts, the up-down counter state will be set at 17 which is the first key address to be sampled according to Table I for the note $C_3$. If the adjacent notes are not to be inhibited the flip-flop circuit 38 will be a single flip-flop stage and the keyboard enable signal will be produced as soon as the system switches to the down mode. The CEG chord corresponds to input enables on the 3, 8 and 12 key positions of the multiplexer 33. As the up-down counter counts down only those addresses which correspond to 3, 8 or 12 key positions will cause an enable to occur on the multiplexer 33, this signal being sensed along the line 41 and labeled chord enable. When the up-down counter counts down through 15 and 12 chord enable signals are applied to the AND gate 40. Since the keyboard enable is also in an activated state, when the clock strobe signal from invertor 46 is in the proper state, the enable signals to the three demultiplexers will be present during these two counts. The addresses for the multiplexers are the same as the addresses for the demultiplexers, as indicated in Table II. Therefore, as the up-down counter sequences through states 15 and 12, output pulses will occur on those counts from the demultiplexer 30.

The outputs from the demultiplexers 30, 31 and 32 are delivered to the previously reset buffer latching circuits 14 and for the example discussed herein the latches 12 and 15 will be set. The outputs of the latches 14 are applied to the diodes 16 to allow a low signal from either the key switch or the latches to operate the keyers. The chords thus enabled to the upper manual keyers for this particular example are $C_3$, $E_2$ and $G_2$. Up to 11 additional keys in an octave below an upper manual keyboard activated note can be turned on in this manner.

When the up-down counter reaches the count binary 9 (001001), which is the state stored in the buffer latches 26, the identity circuit 27 will produce a reset signal for the flip-flop circuit 38 which, in turn, will remove the keyboard enable and through the up-down counter control, reset the up-down counter. This system will remain in a standby state until the scan oscillator indicates the time to start another search mode.

If a CEG chord is again played on the lower manual but a $C\#_3$ is played on the upper manual, a slightly different sequence of operation occurs. As previously, the search mode will begin upon the command of the scan oscillator and the up-down counter will start at count zero and proceed counting upwardly. The latch circuits 14 will also be reset at this point in the sequence. As soon as the up-down counter reaches count 21, a "key on" condition will be detected at the output of the OR gate 36. This occurrence will again start the sample mode, and the buffer latches 26 will be set to state ten, from the output of ROM 24, by the output of OR gate 37. As previously on "key on" detection, flip-flop circuit 38 will be activated. As in the previous example, the up-down counter mode will change to a down count but the keyboard enable signal on line 42 will be inhibited for two counts. If during these two counts a detected chord note occurs, as indicated in the chord enable line 41, the flip-flop circuit 38 will produce another latch command and apply it to the buffer latches 26 via the line 53 through the OR gate 37 to strobe the new number into the latching circuit 26. This new number, which occurs on the following clocked count, determined by the signal into the buffer latches 26 from invertor 46, for this example will correspond to the note $B_2$ at position 19 of Table I. The lower limit of $B_2$ is reference numeral 8. This mechanism of double latching allows an inhibited note to be played an octave lower if desired. This mechanism can, as described previously, obviously be inhibited, if desired. Thus, for the activation of note $C\#_3$ with adjacent note inhibiting and octave adjacent note shifting, the chord enabled to the upper manual keyers is $C_2$, $E_2$ and $G_2$. The techniques for passing the enabled chord notes through the demultiplexers 30, 31 and 32 to the buffer latches 14 and through the diodes 16 of the keyers is identical to that described hereinabove.

In the illustrated embodiment, the other notes on the upper manual keyboard could be activated above the lowest detected note without having any effect on the automatic chord control operation previously described. If no chord is activated on the lower keyboard, but the circuitry is turned on, the search mode will again start on command of the scan oscillator. The system will sequence through the whole keyboard of 44 notes and arrive at the zero count which will cause the up-down counter to put the system in the standby mode until the next scan activator signal from the scan oscillator 21.

The system of this invention incorporates an automatic chord control command which can turn the circuitry on and off. In addition, a special line to the read only memory circuit 24 is contained which can cause the output lines 51 to be modified to change the lower limit of the keyboard enable signals.

The circuit arrangement of FIGS. 2A and 2B is versatile in that it provides a complex lower-to-upper manual chord transformation in an easy to play manner. This system is compatible with and can be used in conjunction with existing large integrated circuit keying and chord chips such as those identified by Part No. 141097 and 660519 obtained from the Wurlitzer Company. These large scale integrated circuit chips are presently used in organs, and, therefore, the utilization of these components with automatic control systems as disclosed herein reduces substantially the feature cost on electronic organs.

The various mode options disclosed herein can be integrated into the basic system with minimum of additional circuitry and can be either hard wired or switchably selected.

In an alternate embodiment of the present invention, the chord control circuit of this invention includes in addition to the normal lower manual keyboard multikey function, a Touch Tone chord control provision which enables the user to produce the entire transformed chord with a single finger. In the embodiment disclosed hereinabove, any number of lower manual keys were transferred to play through the upper manuals in the octave below the lower most upper manual note being played. However, in the embodiment disclosed in FIGS. 3A and 3B, both this latter function and the Touch Tone mode of operation are available for note transfer. When used with the automatic chord control, the Touch Tone chords are a system where certain lower manual notes activate chords which, in addition to playing an accompaniment chord normally, transfer that corresponding chord to the upper manual in the octave below the lower most upper manual note being played. In the illustrated embodiment, there are nineteen Touch Tone chords and these are incorporated in FIGS. 3A and 3B. Furthermore, it will be understood that only those portions of the logic diagram necessary for a complete understanding of the present invention are illustrated. For example, "22 input" lines 60 are shown going to an up control 76, down control 77 and up-down counter divide-by-88 circuit component 61 which, in turn, has the address information therefrom delivered over a trunk line 62 to an input multiplexer 63 and up and down controls 76 and 77. Although not needed for a 44 note keyboard, the up-down counter is shown with a divide-by-88 capability in order to allow the possibility of using an 88 note manual with this system. The output of the up-down counter divide-by-88 circuit 61 also is applied to the binary 16 to binary 12 converter circuit 64. Information to the input multiplexer 63 is received from and delivered to the keyer over a trunk line 66. This trunk line is also connected to an output buffer 167 which is a 44 stage circuit for the 44 notes of the keyboard. The corresponding output shift register 67 passes its data along trunk 166 to the output buffer 167. This shift register has one line 68 thereof for receiving gate clock signals and a data line 72 for coupling the note enable control circuit 73 thereto. The output buffer 167 receives a reset pulse on line 69 from the up control 76. It also receives a strobe signal on line 71 from the same up control 76. A low frequency scan oscillator 74 has the output thereof coupled to the up control 76. The lower manual multiplexer counter 70 which has a capacity of 64 continuously operates providing address lines to a lower manual input multiplexer 81. The up control 76 is coupled to a down control circuit 77 which, in turn, is coupled to the note enable control 73 together with the output of the 12 to 1 multiplex circuit arrangement 78.

The lower manual inputs up to 61 for this particular circuit arrangement are applied to lines 80 coupled to the lower manual input multiplexer circuit 81 which forms a single line 181 depicting the lower manual keyboard state at any time with respect to the state of the lower manual multiplex counter 70. The output line 181 is coupled to both a lower manual 12 note transformation and storage circuit 82 and a Touch Tone scan control 96. A Touch Tone input command 93 goes on line 84 to determine whether the system is in the normal manual or Touch Tone modes for the respective use of circuits 82 or 96. Since there are 19 Touch Tone chords to be formed by the Touch Tone circuit configuration disclosed herein and further since these 19 chords are contained in the first 24 keyboard inputs, line 84 is fed into the lower manual multiplex counter to force it to cycle through 24 states in the Touch Tone mode instead of the normal 64 states. The lower manual multiplex counter 70 is also coupled to a Touch Tone buffer 87 and to a match sensor 88. The output of the Touch Tone buffer 87 is coupled back to the match sensor 88 and to the five chord lines of the Touch Tone read only memory 89. The output of the read only memory 89 is coupled over twelve lines to OR gates 90. The OR gates 90 also receive signals from the lower manual 12 note transformation and storage circuit 82 over twelve lines, indicated generally by reference numeral 91, and the output of the OR gates 90 is delivered to the 12-to-1 multiplexer 78 over twelve lines indicated generally by reference numeral 92.

As stated previously, in the Touch Tone mode of operation, the lower manual multiplex counter 70 sequences through only the first 24 notes repeatedly. The Touch Tone input line 93 is ungrounded during the Touch Tone mode of operation. This is accomplished by the switch 119 of FIG. 1 when the switch is in the T.T. (or Touch Tone) position. When this switch is in the M position the chord circuit will operate in the standard mode. In order to better understand the operation of the Touch Tone mode it must be understood that when power is first turned on, the clear signal on line 94 will be automatically activated and the Touch Tone buffer 87 will be reset to have all zeros therein. This Touch Tone buffer 87 will also be reset if the Touch Tone input 31 is grounded. (Non-Touch Tone mode). This reset state corresponds to no chord or no audio output. As the input multiplexer 81 sequences according to the states of the lower manual multiplex counter 70, the output on 181 will change when a key depression is noted. Table III shows a cross-reference between lower manual multiplex counter states and the Touch Tone chords and lower manual notes.

TABLE III

LOWER MANUAL MULTIPLEX SYSTEM (61 Note Manual)

| Reference Number (Lower Manual Counter States) | Note | Chord |
|---|---|---|
| 1(100000) | F1 | FAC |
| 2(010000) | F#1 | FACD# |
| 3(110000) | G1 | GBD |
| 4(001000) | G#1 | GBDF |
| 5(101000) | A1 | AC#E |
| 6(011000) | A#1 | AC#EG |
| 7(111000) | B1 | A#DF |
| 8(000100) | C2 | CEG |
| 9(100100) | C#2 | CEGA# |
| 10(010100) | D2 | DF#A |
| 11(110100) | D#2 | DF#AC |
| 12(001100) | E2 | EG#BD |
| 13(101100) | F2 | FCG |
| 14(011100) | F#2 | Skip |
| 15(111100) | G2 | GA#D |
| 16(000010) | G#2 | Skip |
| 17(100010) | A2 | ACE |
| 18(010010) | A#2 | Skip |
| 19(110010) | B2 | A#C#F# |
| 20(001010) | C3 | CD#G |
| 21(101010) | C#3 | Skip |
| 22(011010) | D3 | DFA |
| 23(111010) | D#3 | Skip |
| 24(000110) | E3 | EGB |
| 25(100110) | F3 | None |
| 26(010110) | F#3 | None |
| 27(110110) | G3 | None |

TABLE III-continued

LOWER MANUAL MULTIPLEX SYSTEM (61 Note Manual)

| Reference Number (Lower Manual Counter States) | Note | Chord |
|---|---|---|
| 28(001110) | G#3 | None |
| 29(101110) | A3 | None |
| 30(011110) | A#3 | None |
| 31(111110) | B3 | None |
| 32(000001) | C4 | None |
| 33(100001) | C#4 | None |
| 34(010001) | D4 | None |
| 35(110001) | D#4 | None |
| 36(001001) | E4 | None |
| 37(101001) | F4 | None |
| 38(011001) | F#4 | None |
| 39(111001) | G4 | None |
| 40(000101) | G#4 | None |
| 41(100101) | A4 | None |
| 42(010101) | A#4 | None |
| 43(110101) | B4 | None |
| 44(001101) | C5 | None |
| 45(101101) | C#5 | None |
| 46(011101) | D5 | None |
| 47(111101) | D#5 | None |
| 48(000011) | E5 | None |
| 49(100011) | F5 | None |
| 50(010011) | F#5 | None |
| 51(110011) | G5 | None |
| 52(001011) | G#5 | None |
| 53(101011) | A5 | None |
| 54(011011) | A#5 | None |
| 55(111011) | B5 | None |
| 56(000111) | C6 | None |
| 57(100111) | C#6 | None |
| 58(010111) | D6 | None |
| 59(110111) | D#6 | None |
| 60(001111) | E6 | None |
| 61(101111) | F6 | None |

As shown in Table III, reference numerals 14, 16, 18, 21 and 23 are inoperative in the Touch Tone mode since no chords are associated with these keys. If a key depression is noted on one of these keys, the system will ignore the activation and continue to sequence looking for a valid key depression. As soon as a valid key depression is noted, the Touch Tone scan control 96 will initiate a search signal during the next consecutive 24 note scan. On this scan at the lowest manual note activation, which corresponds to an actual chord, the Touch Tone scan control 96 will provide a load command to the Touch Tone buffer 87. The load command will effect a transfer of the lower manual counter 70 states into the buffer 87. The buffer 87 feeds the Touch Tone read only memory circuit 89 which, in turn, produces the notes of the corresponding chord. The buffer 87 contents will remain until either the key which produced the chord is released and a new key activated or the clear line 94, is activated. As soon as this corresponding key is released, the Touch Tone scan control circuit 96 will detect this condition because it continually observes the key activated signal on line 181 during the time of a match signal on line 188 from the match sensor 88. The system, upon key release, will start to look for a new key depression, and when the new activation is detected, the buffer 87 is reloaded with the new chord and the information is delivered to the Touch Tone read only memory 89, as described above. At any time the Touch Tone buffer 87 can be reset and the Touch Tone ROM 89 zeroed by either the clear signal on line 94 or the switching out of the Touch Tone mode of operation, as indicated by the Touch Tone input 93 being grounded.

Figure 5:
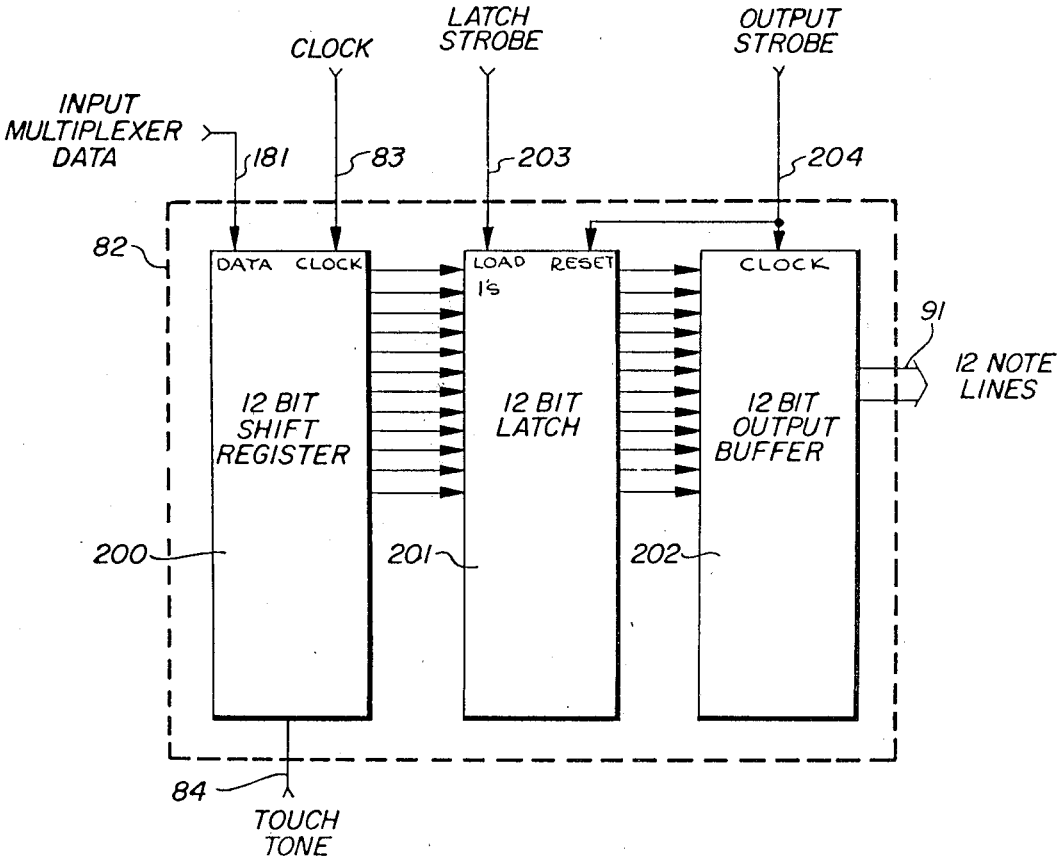
FIG. 5 is a simplified block diagram of the lower manual twelve note transformation and storage circuit.

When the Touch Tone input is grounded, the system is in the normal lower manual operational mode, and the scanning from the lower manual multiplex counter 70 will cause the input multiplexer 81 to go through all 61 states. The multiplexer 81 output on line 181 is fed to the lower manual 12 note transformation and storage circuit 82 which is shown in detail in FIG. 5. The input multiplexer data on line 181 is fed as data into the 12 bit shift register 200. This shift register is held reset in the Touch Tone mode so that all 12 output lines 91 will be inactive during Touch Tone operation. The shift register shifts the data in at the multiplex clock rate on line 83 from counter 70. The 12 bit shift register 200 output is sampled by a rate from the multiplex counter 70. This rate which is called latch strobe comes from the counter 70 on line 203. The latch strobe, which occurs after every 12 bits of data are shifted into the shift register causes any particular latch circuit of the 12 total in circuit 201 to go to a "1" state if the corresponding shift register stage is at a "1" at the time of the latch strobe signal. The output strobe signal on line 204 from the counter 70 will sample the 12 latch output states from circuit 201 and will store the resulting states in the 12 bit output buffer 202. The output strobe signal will occur at the end of multiplex period (as indicated by reference numeral 61 in Table III). This strobe signal on line 204 will also reset the 12 bit latch 201 after its states have been sampled and stored in the 12 bit output buffer 202.

The twelve note lines from the Touch Tone read only memory circuit 89, or the lower manual 12 note transformation and storage circuit 82 which has 12 note outputs on lines 91, are fed to the 12-to-1 multiplexer controller 78 through the OR gates 90.

Figure 3A:
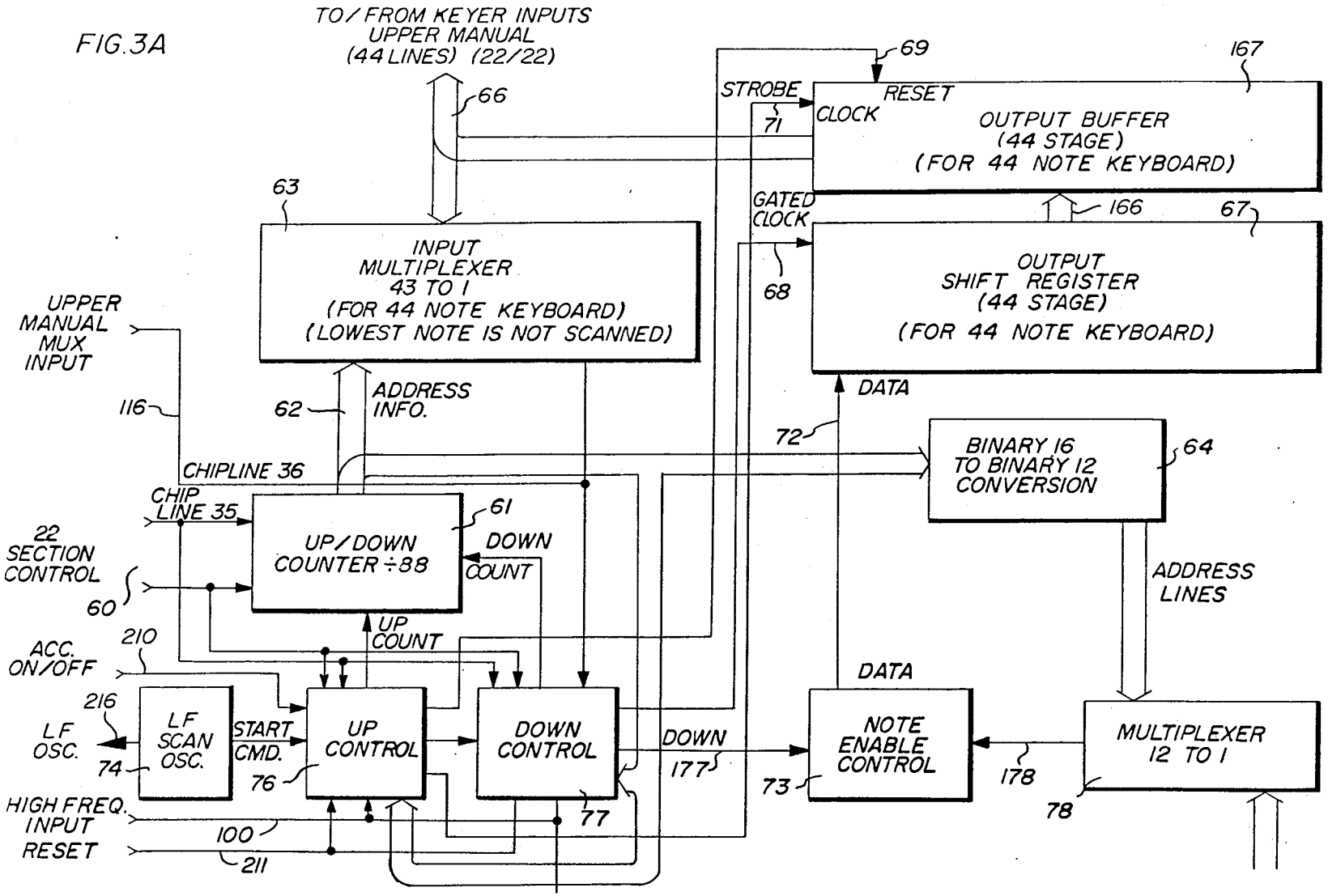
FIGS. 3A and 3B are to be placed horizontally, one above the other, with FIG. 3A on top to provide an overall block diagram of an alternate form of the control circuit of this invention.
Figure 3B:
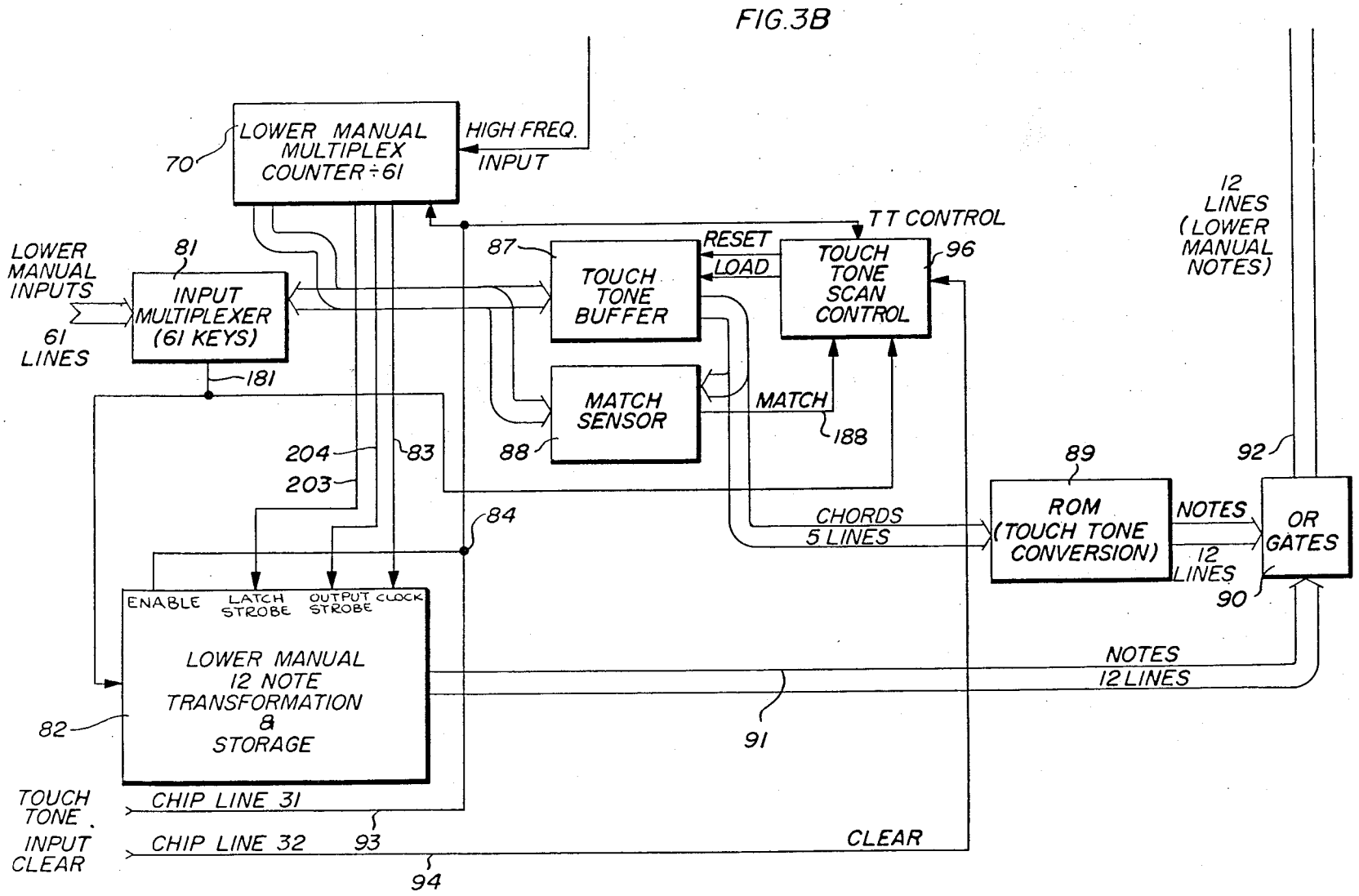

The circuit illustrated in FIGS. 3A and 3B has been arranged to simplify the output circuitry feeding the upper manual keyer inputs along lines 66. The output shift register circuit 67 and output buffer 167 replaces the three 16 bit demultiplexer stages 30, 31 and 32 together with buffer latch circuit 14 of FIGS. 2A and 2B.

The operation of the circuitry illustrated in FIGS. 3A and 3B is substantially the same with the up-down counter circuit 61 scanning up to determine the lowest upper manual note activated, and when the up-down counter reverses, the 44 stage shift register 67 will now insert logic "ones" every time a lower manual activated note is traversed.

The determination of a lower manual activated note traversal is made by the 12-to-1 multiplexer 78 and the note enable control 73. While the up-down counter-divide-by-88 counts down a gating signal is fed on line 177 from the down control 77 to the note enable control 73. Also during the down counting, the binary 16 to binary 12 conversion circuit 64 will cycle by twelve addresses and will feed the 12-to-1 multiplexer 78. Thus, the 12-to-1 multiplexer 78 will enable like named notes from its twelve inputs on each down counter count. In either Touch Tone or normal lower manual operation, if a like named note is activated or is part of a chord, a gating signal will be provided on line 178 to the note enable control 73 during the proper address period. The note enable control 73 will provide this signal on line 72 as data to the output shift register 67. The data on line 72 will be shifted into the output shift register 67 according to the gated clock on line 68. The gated clock is continually applied to the shift register during up-down counter down counting. As the up-down counter shifts downward, the shift register 67 will shift the data from left to right. When the up-down counter reaches the zero state, the shift register will stop shifting and the parallel output will be identical to that in the 44 stage buffer latch circuit 14, previously described in FIG. 2A. The output buffer 167 will store keyboard information during the down counting so that there are no rapid keyer input changes which might cause audio noise problems in the organ. The output buffer 167 receives the parallel output of the output shift register on lines 166. The output 167 will be reset prior to the up counting so that as stated previously, the input multiplexer 63 will only receive information on lines 66 from the keyboard. Output buffer 167 will load from the contents of the output shift register 67 at the end of both up and down periods. In this way the output information on lines 66 will turn off during up counting so as not to be confused with keyboard information and will turn back on at the end of up counting and also will update, if necessary, at the end of down counting.

As mentioned above, the entire automatic chord control circuit of this invention, incorporating any of the modes of operation described herein, can be made from large scale integrated circuit chips. FIG. 4 illustrates the construction of an automatic chord control circuit using two identical LSI chips for one particular type of system using 44 note upper and lower organ manuals and an external lower manual multiplexer. Each LSI chip contains the circuitry on FIGS. 2A and 2B with the exception that only 22 lines come from the upper manual keyers on each chip. In addition, the lower manual multiplexer is external to the chips. On FIG. 4 it can be seen that the 44 lines from the upper manual pass along a cable 110 which is split to apply 22 input lines to a first large scale integrated circuit chip 111 and 22 input lines to a second large scale integrated circuit chip 112. The Touch Tone input signal is applied to a line 113 while the clear signal is applied to a line 114. The "22 control lines" shown as 60 on FIGS. 3A and 3B control which consecutive set of 22 upper manual lines are controlled by the particular automatic chord control integrated circuit. With both "22 control lines" grounded as they are into automatic chord control integrated circuit 111, this particular chip will then control the first 22 upper manual lines. In addition, this first chip 111 will provide the lower manual multiplexer address lines on 117 both to automatic chord control integrated circuit 112 and to the lower manual multiplexer 81. The "22 control lines" to chip 112 on lines 60 are set up with the bottom line grounded and the upper line left open. Chip 112 interprets the "22 control" inputs to mean that it covers the second 22 upper manual lines 110 and that it receives the lower manual multiplexer address lines 117 and the low frequency scan oscillator output on line 216 from chip 111. Since the high frequency input on line 100 and the upper manual multiplex input on line 116 are common between the two chips 111 and 112, it is apparent that the two chips operate in time synchronism. The functioning of the two chips together is identical to the description for FIGS. 3A and 3B. An automatic chord control on/off on line 210 and a logic power on reset on line 211 are provided for organ control. The lower manual inputs are provided on line 80 to the lower manual multiplexer 81 and the lower manual multiplexer single output corresponding to addresses 117 is provided on line 118 to each LSI chip.

While several circuit arrangements have been illustrated herein, it will be understood that further variations and modifications of this invention may be incorporated without departing from the spirit and scope of the novel concepts set forth in the following claims.

The invention is claimed as follows:

1. An electronic musical instrument comprising: tone generator means capable of producing a plurality of musical tones, a primary keyboard portion having a plurality of keys corresponding to a plurality of musical tones associated therewith, at least one secondary keyboard portion having a plurality of keys corresponding to a plurality of musical tones associated therewith, a plurality of key-operated switches, each operated by one of the keys of said primary and secondary keyboard portions, digital logic means operatively coupled with said tone generator means and with said key-operated switches for causing said tone generator means to produce tones in response to the actuation of said keys and including digital means for ascertaining the logic states of each of said key-operated switches, and digital control means operatively coupled with said tone generator means and with said digital means for causing said tone generator means to produce one or more additional musical tones corresponding to musical tones associated with said primary key-board portion in response to and determined by the actuation of one or more keys on said secondary keyboard portion and the actuation of at least one key on said primary keyboard portion, said digital control means including digital decoding means for decoding the note names of said one or more musical tones, said digital decoding means being responsive to the actuation of said one or more keys on said secondary keyboard portion for determining the note names of said one or more additional musical tones.

2. An electronic musical instrument according to claim 1 wherein said digital ascertaining means comprises multiplexing means interconnected with the key-operated switches of at least said secondary keyboard portion.

3. An electronic musical instrument as set forth in claim 2 wherein said digital decoding means includes means coupled with said multiplexing means for developing parallel information identifying note names of said one or more actuated keys, means responsive to said at least one actuated key of said primary keyboard portion for converting said parallel information into data further indentifying note positions, and further including keying means operatively coupled with the key-operated switches corresponding to said primary keyboard portion for keying the tones produced by said tone generating means, and means for transmitting said note name and note position identifying data to said keying means.

4. An electronic musical instrument according to claim 3 wherein said converting means includes shift register means for producing parallel information corresponding to the note names and note positions of said plurality of additional musical tones, said shift register means being responsive to the information identifying note names and to the actuation of said at least one key on said primary keyboard portion for controlling the production by said tone generating means of said additional musical tones in accordance with said parallel information produced by said shift register means.

5. An electronic musical instrument according to claim 1 wherein said digital control means further includes second digital decoding means for causing said tone generator means to produce a plurality of additional tones corresponding to musical tones associated with said primary keyboard portion in response to and determined by the actuation of a single key on said secondary keyboard portion and the actuation of at least one key on said primary keyboard portion, said second decoding means comprising read only memory means responsive to the actuation of said single key on said secondary keyboard portion for decoding the note names of said plurality of additional musical tones, and further including selection means for selecting one or neither of said decoding means and said second decoding means for selectively controlling the production of said plurality of additional musical tones.

6. An electronic musical instrument comprising: tone generator means capable of producing a plurality of musical tones, a primary keyboard portion having a plurality of keys corresponding to a plurality of musical tones associated therewith, at least one secondary keyboard portion having a plurality of keys corresponding to a plurality of musical tones associated therewith, a plurality of key-operated switches, each operated by one of the keys of said primary and secondary keyboard portions, digital logic means operatively coupled with said tone generator means and with said key-operated switches for causing said tone generator means to produce tones in response to the actuation of said keys and including digital means for ascertaining the logic states of each of said key-operated switches, and digital control means coupled with said tone generator means and with said digital means for causing said tone generator means to produce a plurality of additional musical tones corresponding to musical tones associated with said primary keyboard portion in response to and determined by the actuation of a single key on said secondary keyboard portion and the actuation of at least one key on said primary keyboard portion, said digital control means including read only memory means for decoding the note means of said plurality of additional musical tones, said read only memory means being responsive to the actuation of said single key on said secondary keyboard portion for determining the note names of said plurality of additional musical tones.

7. An electronic musical instrument as set forth in claim 6 wherein said digital logic means includes multiplexing means.

8. An electronic musical instrument as set forth in claim 7 wherein said digital control means includes shift register means with which said read only memory means is operatively coupled.

9. An electronic musical instrument as set forth in claim 8 wherein said primary keyboard portion has keyer means associated therewith for keying the tones produced by said tone generating means and the output of said shift register means is operatively coupled with said keyer means.

10. An electronic musical instrument as set forth in claim 9 wherein the output of said multiplexing means is also operatively coupled with said keyer means.

* * * * *

UNITED STATES PATENT AND TRADEMARK OFFICE

CERTIFICATE OF CORRECTION

PATENT NO. : 4,331,057

DATED : May 25, 1982

INVENTOR(S) : ROBERT W. WHEELWRIGHT & PETER E. SOLENDER

It is certified that error appears in the above-identified patent and that said Letters Patent are hereby corrected as shown below:

Column 1, line 55, change "to be preselected" to --to the preselected--;

Column 3, line 58, change "103" to --103B--;

Column 9, line 57, change "large integrated" to --large scale integrated--;

Column 11, line 57, change "FCG" to --FGC--;

Column 14, line 29, change "Figs. 2A and 2B" to --Figs. 3A and 3B--;

Column 16, line 42, change "the note means" to --the note names--;

Signed and Sealed this

*Twenty-fourth* Day of *August 1982*

[SEAL]

*Attest:*

GERALD J. MOSSINGHOFF

*Attesting Officer*

*Commissioner of Patents and Trademarks*